United States Patent [19]

Koreeda

[11] Patent Number: 4,849,724

[45] Date of Patent: Jul. 18, 1989

[54] WAVEGUIDE BAND-PASS FILTER

[75] Inventor: Shuichi Koreeda, Tokyo, Japan

[73] Assignee: NEC Corporation, Japan

[21] Appl. No.: 281,556

[22] Filed: Dec. 8, 1988

[30] Foreign Application Priority Data

Dec. 10, 1987 [JP] Japan ..... 62-310875

[51] Int. Cl.[4] ..... H01P 1/16; H01P 1/208

[52] U.S. Cl. ..... 333/212; 333/208; 333/227; 333/228

[58] Field of Search ..... 333/208, 209, 210, 212, 333/211, 219, 227, 228, 230, 231, 202, 206–207, 203, 222–223

[56] References Cited

U.S. PATENT DOCUMENTS

| | | | |
|---|---|---|---|
| 2,518,092 | 8/1950 | Sunstein et al. | 333/212 X |
| 3,544,927 | 12/1970 | Elder et al. | 333/208 |
| 3,845,422 | 10/1974 | Rhodes | 333/208 |
| 4,731,593 | 3/1988 | Görtz | 333/208 |

*Primary Examiner*—Marvin L. Nussbaum

*Attorney, Agent, or Firm*—Ostrolenk, Faber, Gerb & Soffen

[57] ABSTRACT

A waveguide band-pass filter has at least two resonators each consisting of a high-impedance section and a low-impedance section. The resonators are cascade-connected at intervals of λg/4 in a waveguide.

2 Claims, 4 Drawing Sheets

WAVEGUIDE BAND-PASS FILTER

BACKGROUND OF THE INVENTION

The present invention relates to a waveguide band-pass filter used for a microwave or milliwave and, more particularly, to a waveguide band-pass filter having a higher-order mode blocking function.

In order to obtain an optimal susceptance as a characteristic of a waveguide band-pass filter, a capacitive window for reducing an E-plane size, an inductive window for reducing an H-plane size, or an iris is conventionally used to set an optimal susceptance at a distance of λg/2.

Such a waveguide band-pass filter is used to transmit a signal of only a specific band, and the signal often includes a second-order harmonic wave of a fundamental wave as a spurious component.

In order to block the second-order harmonic wave as the spurious component in the conventional waveguide band-pass filter, a low-pass filter is connected to the waveguide band-pass filter. As a result, a circuit arrangement is complicated, and a compact, lightweight waveguide band-pass filter cannot be obtained.

SUMMARY OF THE INVENTION

The present invention has been made in consideration of the above situation, and has as its object to provide a waveguide band-pass filter having a low-pass filter function for blocking a higher-order mode such as a second-order harmonic wave.

In order to achieve the above object of the present invention, there is provided a waveguide band-pass filter comprising at least two resonators each consisting of a high-impedance section and a low-impedance section, the resonators being cascade-connected at intervals of λg/4 in a waveguide.

DETAILED DESCRIPTION OF THE PREFERRED EMBODIMENT

A preferred embodiment of the present invention will be described with reference to the accompanying drawings.

The prior art will be described before a preferred embodiment of the present invention is described.

Figure 1:
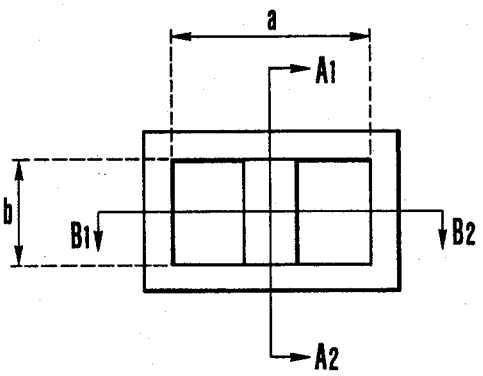
FIG.1 (PRIOR ART)
FIG. 1 is a front view of a conventional waveguide band-pass filter using an inductive window.
Figure 2:
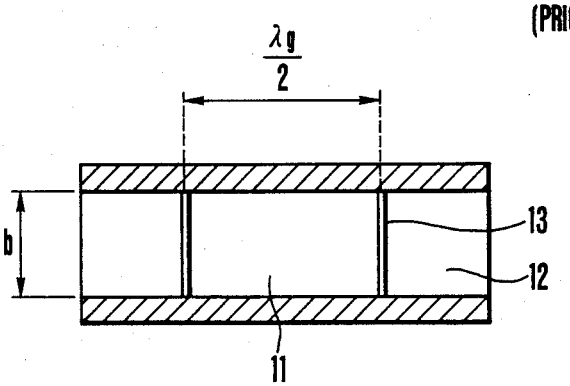
FIG.2 (PRIOR ART)
FIG. 2 is a cross-sectional view of the waveguide band-pass filter shown in FIG. 1 along the line A1–A2 thereof.
Figure 3:
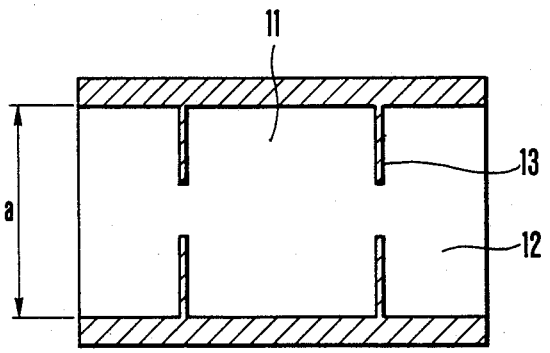
FIG.3 (PRIOR ART)
FIG. 3 is a side sectional view of the waveguide band-pass filter shown in FIG. 1 along the line B1–B2 thereof.

FIG. 1 is a front view of a conventional waveguide band-pass filter using an inductive window, FIG. 2 is a cross-sectional view of the waveguide band-pass filter in FIG. 1 along the line A1–A2 thereof, and FIG. 3 is a side sectional view of the waveguide band-pass filter along the line B1–B2 thereof.

Referring to FIGS. 1 to 3, reference numeral 11 denotes a resonator section of the waveguide band-pass filter; 12, an input/output waveguide opening end; and 13, an opening of the resonator (inductive window).

Figure 4:
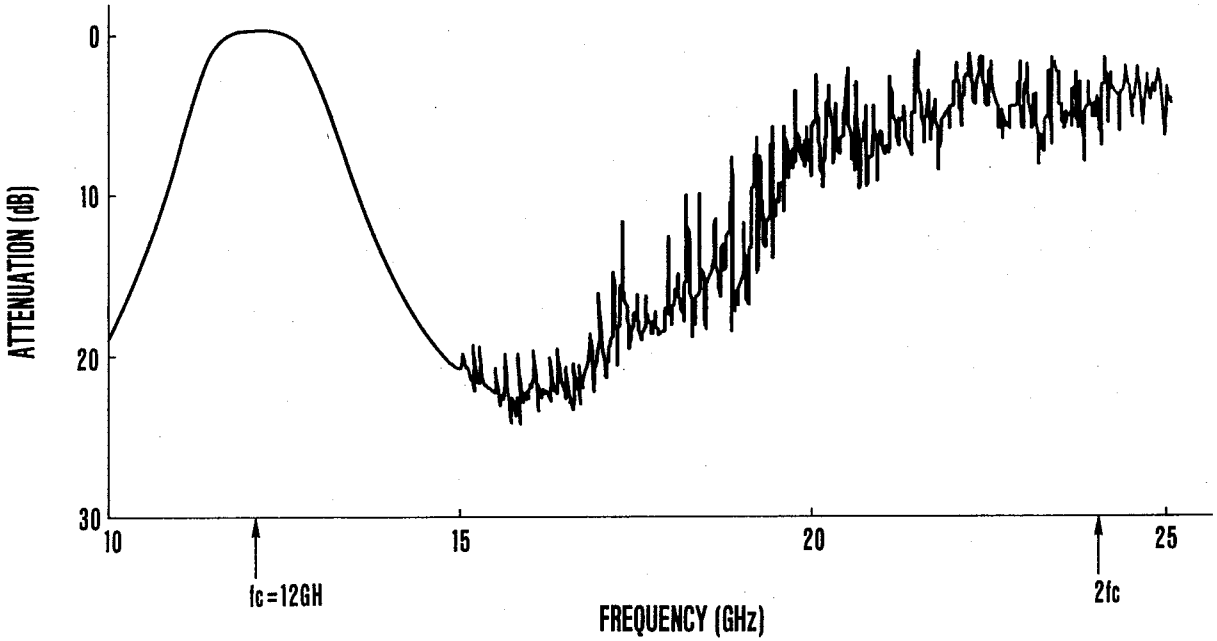
FIG.4 (PRIOR ART)
FIG. 4 is a graph showing characteristics of the conventional band-pass filter.

FIG. 4 shows characteristics of a conventional band-pass filter. The band-pass filter has filtering characteristics of high-order mode components such as the second-order harmonic wave in the same manner as in the fundamental wave, as shown in FIG. 4. Therefore, the second-order harmonic wave cannot be blocked by the band-pass filter.

Figure 5:
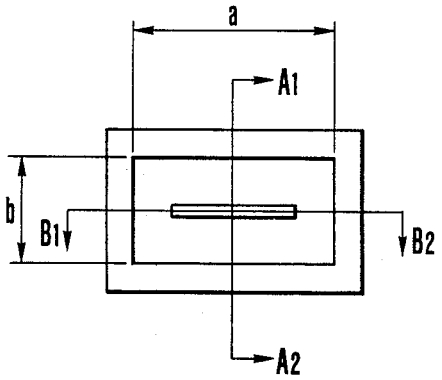
FIG. 5 is a front view of a waveguide band-pass filter according to an embodiment of the present invention.
Figure 6:
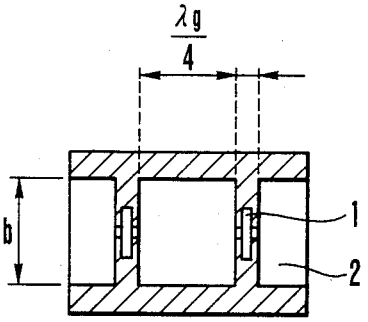
FIG. 6 is a cross-sectional view of a waveguide band-pass filter shown in FIG. 5 along the line A1–A2 thereof.
Figure 7:
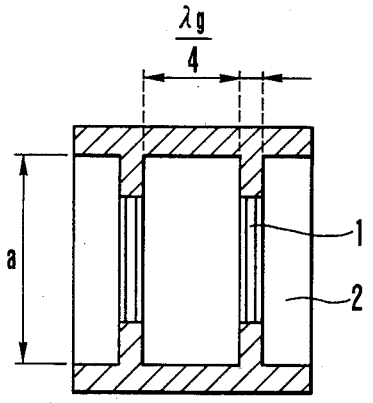
FIG. 7 is a side sectional view of the waveguide band-pass filter of FIG. 5 along the line B1–B2 thereof.
Figure 8:
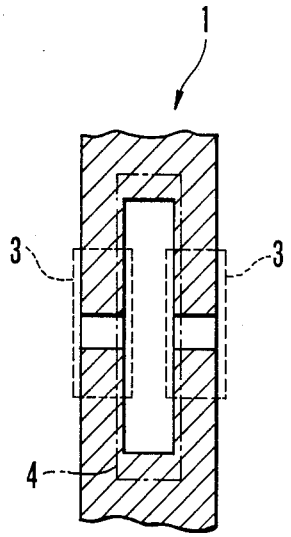
FIG. 8 is a partial enlarged view of the filter shown in FIG. 6.

FIG. 5 is a front view of a waveguide band-pass filter according to an embodiment of the present invention, FIG. 6 is a cross-sectional view thereof along the line A1–A2 in FIG. 5, FIG. 7 is a side sectional view thereof along the line B1–B2 in FIG. 5, and FIG. 8 is a partial enlarged view of the filter shown in FIG. 6.

Referring to FIGS. 5, 6, 7 and 8, reference numeral 1 denotes a resonator section of the waveguide band-pass filter; and 2, an input/output waveguide opening end.

The resonator section 1 is constituted by a combination of high-impedance section 3 and low-impedance section 4.

In the waveguide band-pass filter having the above arrangement, the resonator section 1 has a low-pass filter function for blocking filtering of a band which falls outside the predetermined bandwidth, i.e., for blocking a higher-order mode. For this reason, unlike in the conventional band-pass filter, an additional low-pass filter need not be connected to the waveguide.

Figure 9:
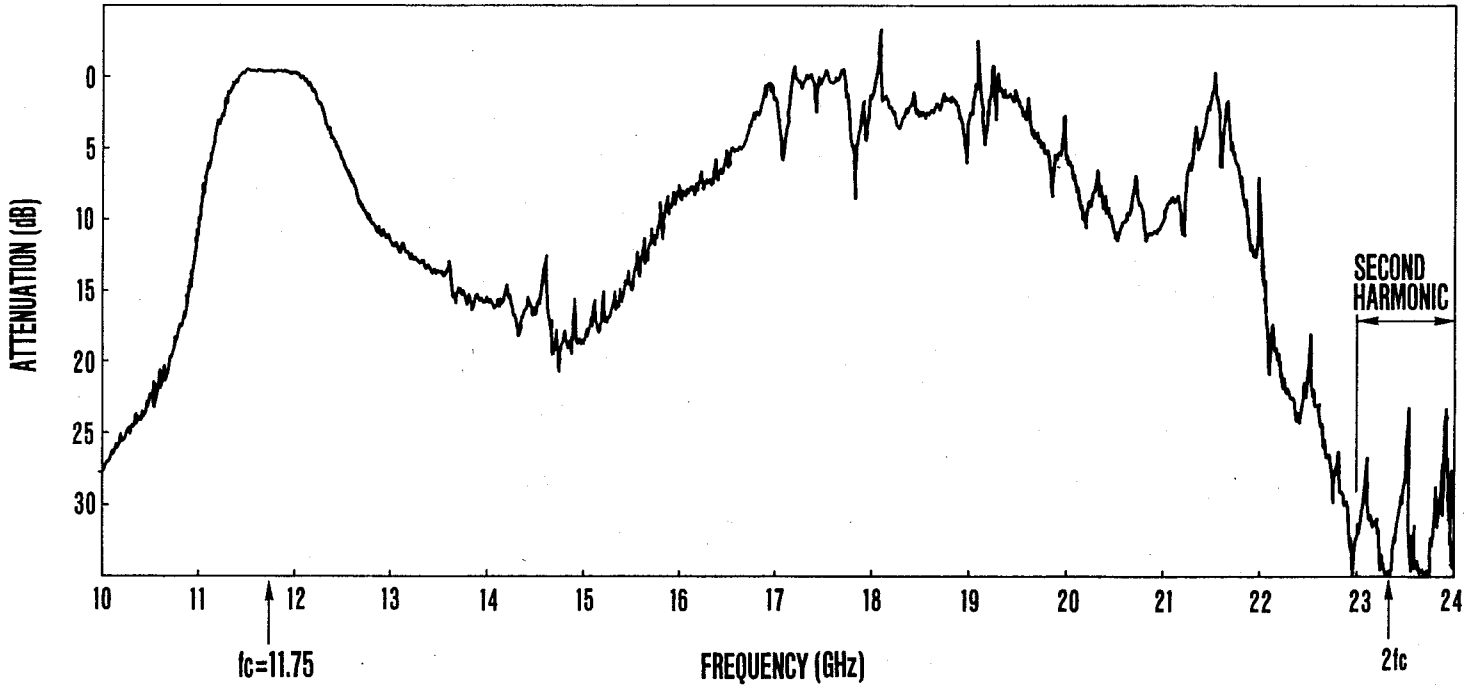
FIG. 9 is a waveform chart showing characteristics of the band-pass filter shown in FIG. 5.

According to this embodiment, in place of the capacitive window for reducing an E-plane size, an inductive window for reducing an H-plane size, or an iris, resonators each consisting of the high- and low-impedance sections 3 and 4 are cascade-connected at intervals of λg/4 in the waveguide, thereby constituting the waveguide band-pass filter. FIG. 9 shows characteristics of this waveguide band-pass filter.

The present invention is not limited to the particular embodiment described above. Various changes and modifications may be made within the spirit and scope of the invention. In the above embodiment, the high- and low-impedance sections are used to change the E-plane size. However, windows having different dielectric constants may be combined.

According to the present invention as has been described above, a plurality of resonators each consisting of the high- and low-impedance sections are cascade-connected at intervals of λg/4 to block the higher-order mode. Therefore, a simple, compact, lightweight waveguide band-pass filter can be provided.

In addition, the number of components constituting the waveguide band-pass filter is small, and the manufacturing cost can be reduced.

What is claimed is:

1. A waveguide band-pass filter comprising at least two resonators each consisting of a high-impedance section and a low-impedance section, the resonators being cascade-connected at intervals of λg/4 in a waveguide.

2. A filter according to claim 1, wherein the high- and low-impedance sections of each of said resonators are constituted by changing an E-plane size of the waveguide.

* * * * *